US006629381B1

(12) United States Patent
Keng

(10) Patent No.: US 6,629,381 B1
(45) Date of Patent: Oct. 7, 2003

(54) REINFORCED FIREARM SIGHT SUPPORT RING

(76) Inventor: Da Keng, 1553 Shamrock Trail, SE., Smyrna, GA (US) 30080-5853

( * ) Notice: Subject to any disclaimer, the term of this patent is extended or adjusted under 35 U.S.C. 154(b) by 0 days.

(21) Appl. No.: 09/495,841

(22) Filed: Feb. 1, 2000

Related U.S. Application Data

(60) Provisional application No. 60/118,032, filed on Feb. 1, 1999.

(51) Int. Cl.[7] ..... F41A 15/00
(52) U.S. Cl. ..... 42/124; 33/245
(58) Field of Search ..... 42/124, 125, 126; 33/245

(56) References Cited

U.S. PATENT DOCUMENTS

| | | | | |
|---|---|---|---|---|
| 4,291,476 | A | 9/1981 | Repa | 42/15 T |
| 4,835,895 | A | 6/1989 | Bowen | 42/101 |
| 4,862,624 | A | 9/1989 | Williams | 42/101 |
| 4,941,277 | A | 7/1990 | Lawlor | 42/100 |
| 5,070,637 | A | 12/1991 | French | 42/101 |
| 5,086,566 | A | 2/1992 | Klumpp | 42/101 |
| 5,144,752 | A | 9/1992 | Boeke et al. | 42/101 |
| 5,353,539 | A | 10/1994 | Zeh | 33/250 |
| 5,355,607 | A | 10/1994 | Klotz | 42/101 |
| 5,390,419 | A | 2/1995 | Sirkis | 42/101 |
| 5,396,725 | A | 3/1995 | Talbot | 42/101 |
| 5,400,539 | A | 3/1995 | Moore | 42/101 |
| 5,425,191 | A | 6/1995 | Taylor et al. | 42/101 |
| 5,428,915 | A | 7/1995 | King | 42/101 |
| 5,522,166 | A | 6/1996 | Martel | 42/124 |
| 5,570,529 | A | 11/1996 | Amelino | 42/101 |
| 5,595,011 | A | 1/1997 | Gorslin | 42/101 |
| 5,606,818 | A | 3/1997 | Hardee | 42/101 |
| 5,669,173 | A | 9/1997 | Rodney, Jr. | 42/101 |
| 5,680,725 | A | 10/1997 | Bell | 42/101 |
| 5,694,712 | A | 12/1997 | Plonka | 42/101 |
| 5,784,822 | A | 7/1998 | Korapaty | 42/101 |
| 5,806,228 | A | 9/1998 | Martel et al. | 42/101 |
| 6,295,754 | B1 | 10/2001 | Otteman et al. | 42/111 |

*Primary Examiner*—J. Woodrow Eldred
(74) *Attorney, Agent, or Firm*—Liniak, Berenato & White, LLC

(57) ABSTRACT

A reinforced scope ring can be used singly or in pairs and can be affixed to a Weaver or Picatinny rail. The reinforced scope ring includes a base, a removable jaw attached to the base by first and second transverse threaded fasteners and first and second knurled nuts, first and second semi-cylindrical split rings and a substantially semi-cylindrical top ring member which is removably attached to the base. The base includes first and second apertures aligned perpendicular to the scope axis and spaced apart by approximately 0.80 inches to engage alternate transverse notches in the Picatinny rail. The first and second transverse threaded fasteners have an elongate body with a substantially rectangular cross section to provide transverse lug surfaces tending to fill the transverse notches in the Picatinny rail and engage notch surfaces in the left and right rail members.

6 Claims, 6 Drawing Sheets

18
20
26
50
58
59
54
56
34
36
28
32
30

REINFORCED FIREARM SIGHT SUPPORT RING

The present application claims benefit of the filing date for Provisional application 60/118,032, filed on Feb. 1, 1999, the entire disclosure of which is incorporated herein by reference.

BACKGROUND OF THE INVENTION

1. Field of the Invention

The present invention relates to a support or mount for an optical device such as a firearm sight and a method for mounting optical devices such as telescopic sights on large caliber rifles or other firearms generating substantial recoil forces.

2. Discussion of the Prior Art

At present, a wide variety of optical sights are available for use on firearms such as rifles. Telescopic sights, night vision sights, and illuminated red dot electronic sights are often used in a variety of situations. An optical sight for use on a firearm such as a rifle is customarily optically aligned along the axis of the bore and used to align the bore of the firearm with the target. Sights are usually adjustable in the left and right direction for "windage" and in the up and down direction for "elevation." Usually, a shooter will mount a telescopic sight or the like to a firearm using a pair of telescopic sight supporting rings (or scope rings) and then immediately "zero" the sight by a procedure of adjusting windage and elevation settings so that the sight's point of aim corresponds with the point of impact for a selected target at a desired range.

If a telescopic sight is mounted with the scope rings of the prior art to a large caliber rifle or other firearm generating large recoil forces, the zero may change after firing several rounds and the telescopic sight must be adjusted for proper zero again.

There are many kinds of mounting structures for attaching and supporting sights on firearms. The Picatinny arsenal of the U.S. Army has developed an elongate mounting rail known as the "Picatinny rail," which has become one of the industry standards for mounting a telescopic sight on a rifle or other firearm. The Picatinny rail is similar to the Weaver™ rail or Weaver base having first and second parallel, elongate rail members disposed parallel to the firearm bore. The Weaver base supports or carries telescopic sight supporting rings (i.e., scope rings) to rigidly mount a telescopic sight; customarily, two scope rings are used to encircle and support a tubular telescopic sight body. The scope rings are usually spaced apart at a distance of two to six inches and attached along the elongate rail. The Picatinny rail differs from the Weaver rail in that a plurality of transverse notches cross the parallel elongate rail members. Mounting the scope rings of the prior art with either the Weaver rail or the Picatinny rail requires substantial effort since the scope must be properly aligned and leveled in the scope rings while on the base. As noted above, if the zero adjustment of the scope changes in response to recoil or other forces, the zeroing effort will have been wasted and the scope mounting and zeroing procedure must be repeated.

There has been a long felt need, then, for a method and apparatus permitting attachment of a telescopic or tubular sight on a firearm in a convenient manner which is also more likely to retain the sight adjustment or zero.

OBJECTS AND SUMMARY OF THE INVENTION

Accordingly, it is a primary object of the present invention to overcome the above mentioned difficulties by providing a method and apparatus permitting the user to rigidly affix a sight onto a firearm in a manner likely to preserve the sight adjustment or zero.

Another object of the present invention is removably attaching an optical device to a mount with one or two attractively designed reinforced scope rings.

The aforesaid objects are achieved individually and in combination, and it is not intended that the present invention be construed as requiring two or more of the objects to be combined unless expressly required by the claims attached hereto.

The reinforced scope ring of the present invention preferably has a cylindrical length greater than its diameter and uses first and second threaded transverse lug fasteners and can be used singly or (for weapons having especially severe recoil) can be used in pairs, and can be affixed to a conventional Picatinny rail mounted on a firearm (e.g., onto the receiver of a rifle). The reinforced scope ring includes a base, a removable jaw attached to the base preferably by first and second transverse threaded fasteners and first and second knurled nuts. First and second semi-cylindrical split rings and a substantially semi-cylindrical top ring member are removably attached to the base. The base includes first and second transverse apertures aligned across the scope axis and spaced apart by approximately 0.80 inches to engage alternate transverse notches in the Picatinny rail thereby spreading recoil forces over alternate notches in the rail. The first and second transverse threaded lug fasteners have an elongate body with a substantially rectangular cross section to provide transverse lug surfaces tending to fill the transverse notches in the Picatinny rail and engage the fore and aft or axially oriented notch surfaces in the left and right rail members. The reinforced scope ring is attached to the Picatinny rail by first inserting the first and second transverse threaded fasteners in the base and then lowering the base onto the rail. The removable jaw has first and second apertures into which threaded fastener distal ends are inserted and then the threaded nuts are tightened onto the threaded fasteners, thus securely affixing the base to the rail.

The base also includes transverse notches spaced at 0.80 inches to engage the transverse lug surfaces of the threaded fastener elongate bodies. Thus, each reinforced scope ring base has spaced parallel engagement surfaces to provide rigid longitudinal support to the scope or other optical sights supported in the scope ring. The threaded transverse fasteners preferably have a flange or cap at one end of the elongate body opposite a tapered section carrying a distal threaded section for engagement with the threaded nuts.

Preferably, the top ring member and the base member form first and second halves of a substantially cylindrical member. The base member has left and right substantially rectangular planar flange members disposed in the plane bisecting the cylinder defined by the reinforced scope ring. The left and right face flange members each include first, second and third threaded bores adapted to receive threaded fasteners for attaching the top ring member to the base member. The top ring member also includes substantially rectangular left and right flanges, each including an array of first, second and third apertures with bores sized to receive the larger head portions of the threaded fasteners used to attach the top ring member to the base member and apply substantial clamping force therebetween. The length dimension of the flange members for the top ring member and the base is disposed in parallel to the central axis of the cylinder defined by the reinforced scope ring and is preferably greater in extent than the scope ring inner diameter, thereby providing sufficient clamping force and support along the length of a scope tube to permit a single reinforced scope ring to be used for most shooting applications.

In an alternative embodiment, a lighter and more slender reinforced scope ring has a single transverse lug fastener with a substantially rectangular cross section. In the preferred embodiment, the exterior surface of the reinforced scope ring semi-cylindrical top ring member has a plurality of parallel, longitudinal grooves separated by narrow ribbed segments. The groove and rib pattern is well suited to diminish reflected glare and provides an additional gripping surface.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
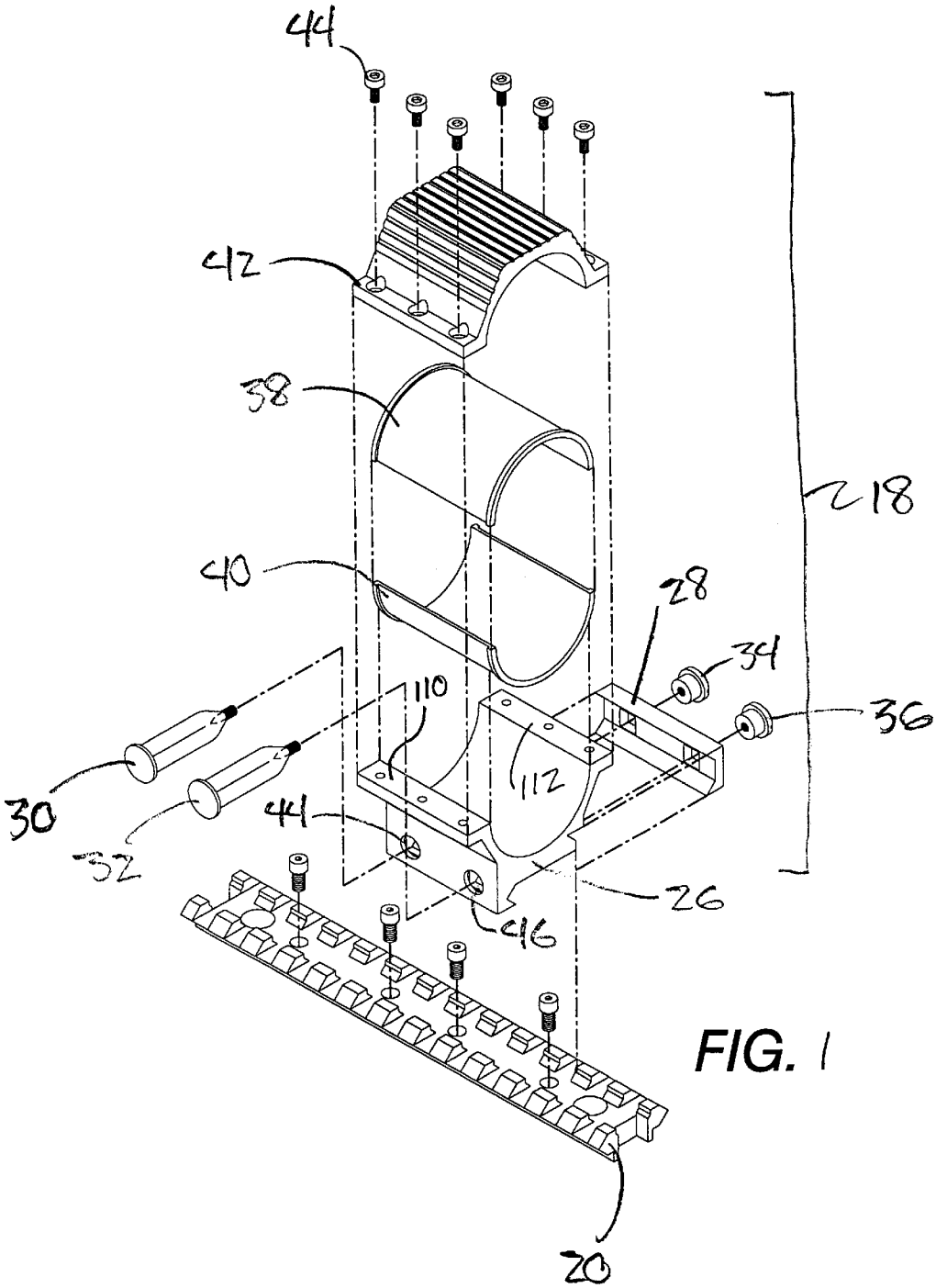
FIG. 1 is an exploded perspective view of a reinforced scope ring base aligned over a Picatinny rail, in accordance with the present invention.
Figure 2:
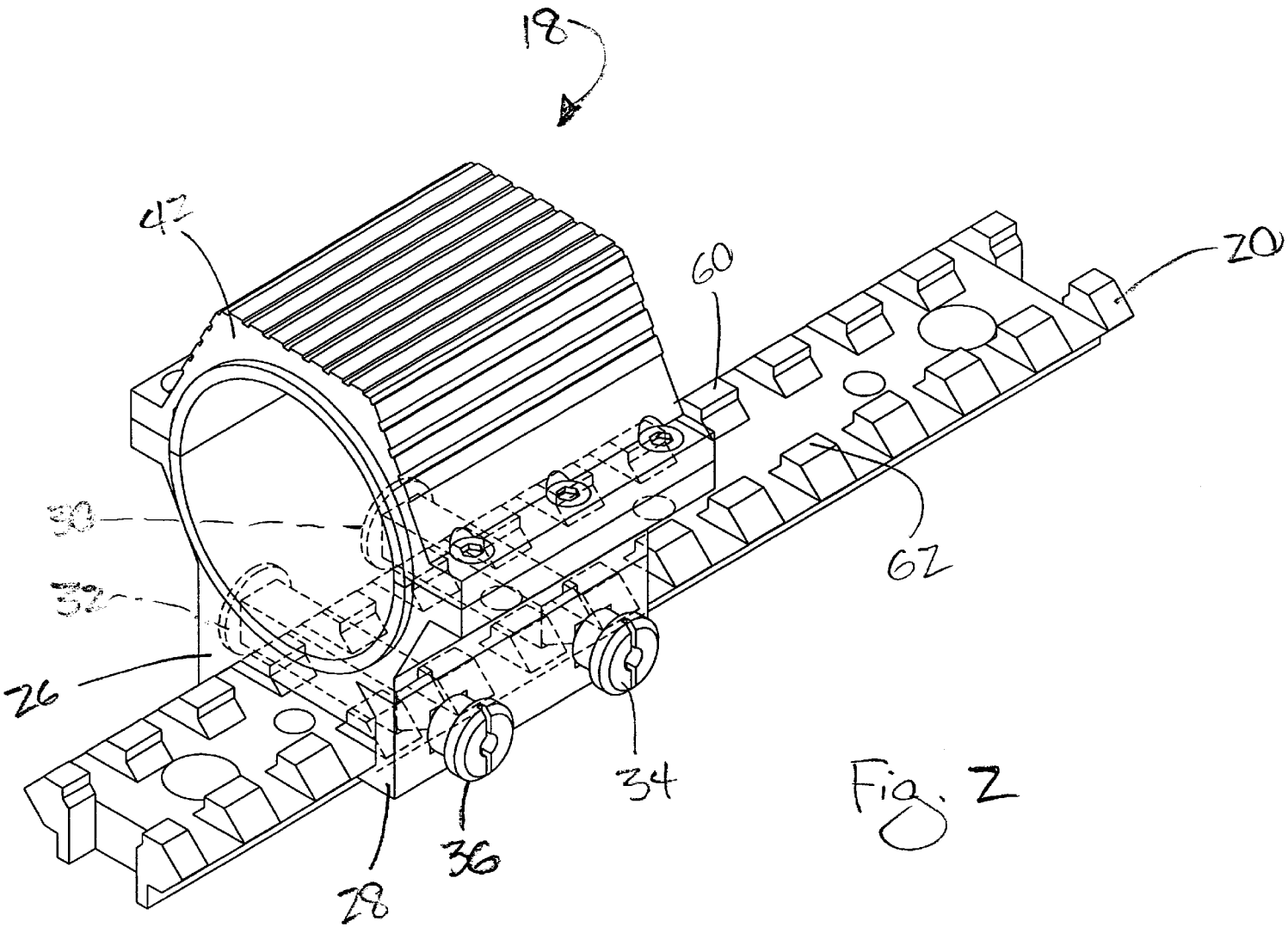
FIG. 2 is a perspective view with phantom lines of the reinforced scope ring illustrating the orientation of the transverse lug members engaging alternate transverse notches in the Picatinny rail, in accordance with the present invention.
Figures 3, 4:
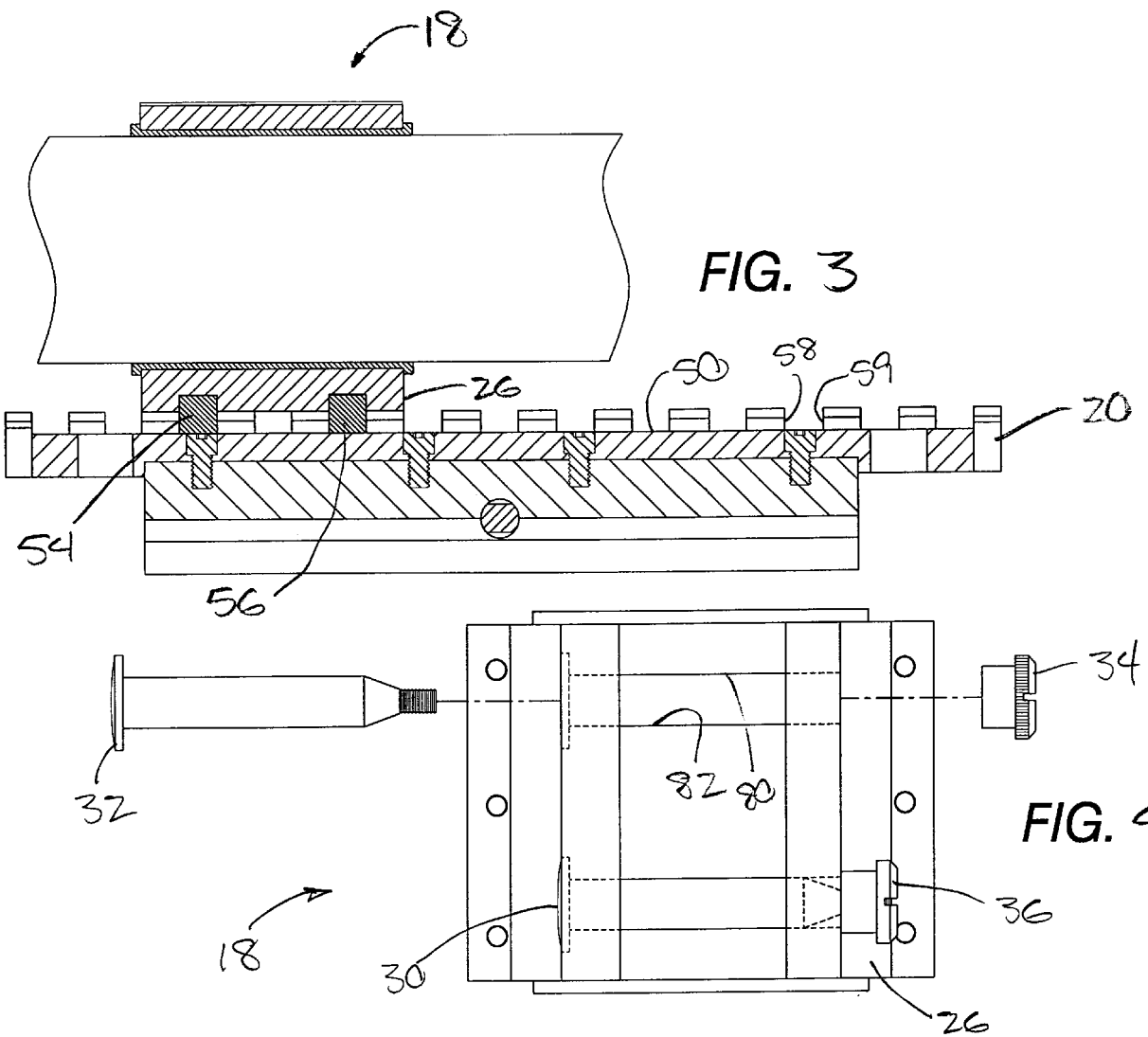
FIG. 3 is a cross sectional view illustrating the transverse lug members of the reinforced scope ring engaged with alternate transverse notches of the Picatinny rail, in accordance with the present invention.
FIG. 4 is a bottom view of the reinforced scope ring of FIG. 3 illustrating the axial alignment of the transverse lug member with the aligned transverse apertures in the reinforced scope ring matting base.

Referring now to FIGS. 1, 2 and 3 of the accompanying drawings, reinforced scope ring 18 is adapted to receive and clamp fixedly onto a sight base such as Picatinny rail 20. Base 26 defines a semi-cylindrical longitudinal interior surface bisected by an imaginary plane including the cylinders longitudinal axis. Left and right planar flanges extend radially outwardly from the cylindrical section and each of the planar flanges has first, second and third threaded apertures adapted to receive threaded fasteners as will be discussed herein below. Optionally, first semi-cylindrical member and second semi-cylindrical member 38, 40 are included for users desiring to use the reinforced scope ring with a smaller sized telescopic sight, for example, a one-inch diameter telescopic tube instead of the larger 30 mm diameter sight tube.

As best seen in the exploded view of FIG. 1, semi-cylindrical top ring member 42 has a semi-cylindrical interior surface terminated at each end in first and second planar support flanges sized to match the planar flange surfaces on base 26. Preferably, the exterior of top ring member 42 defines a substantially planar horizontal surface bounded on opposite sides by left and right angled surfaces terminated in the top ring member left and right planar flanges.

As best seen in FIGS. 2 and 3, reinforced scope ring 18 can be affixed to a conventional Picatinny rail 20 mounted directly onto a firearm (e.g., onto the receiver of a rifle) and includes a base 26, a removable jaw 28 attached to base 26 by first and second transverse threaded lug fasteners 30, 32, first and second knurled nuts 34, 36, and substantially semi-cylindrical flanged top ring member 42 which is removably attached to supporting flanges on base 26, preferably using six threaded fasteners 44 arrayed in two rows of three. Base 26 includes first and second apertures 44, 46 aligned across the scope or longitudinal axis and spaced apart by approximately 0.80 inches (center-to-center), spaced to align with alternate transverse notches in the rail 20. As best seen in FIGS. 2 and 3, first and second transverse threaded lug fasteners 30, 32 have elongate shafts or bodies with substantially rectangular cross sections 54, 56 to provide transverse lug surfaces dimensioned to fill the transverse notches 50 in the rail and engage the fore and aft or axially oriented notch surfaces 58, 59 in the left and right notched rail members 60, 62.

As best seen in FIGS. 3 and 4, reinforced scope ring base 26 also includes first and second parallel and spaced grooves having opposing vertical surfaces, 80, 82 which receive the lug surfaces of threaded lug fasteners 30, 32 and provide bearing surfaces to rigidly fix base 26 on lug fasteners 30, 32 which are, in turn, rigidly supported by the rail transverse notches 50, 52.

In use, reinforced scope ring 18 is attached to rail 20 by first inserting the first and second transverse threaded lug fasteners 30, 32 in base 26 and then lowering base 26 onto rail 20. Removable jaw 28 has first and second apertures 70, 72 into which threaded lug fastener distal ends are inserted and then the threaded nuts 34 are tightened onto the threaded lug fasteners, thus securely affixing base 26 to rail 20.

Figure 5:
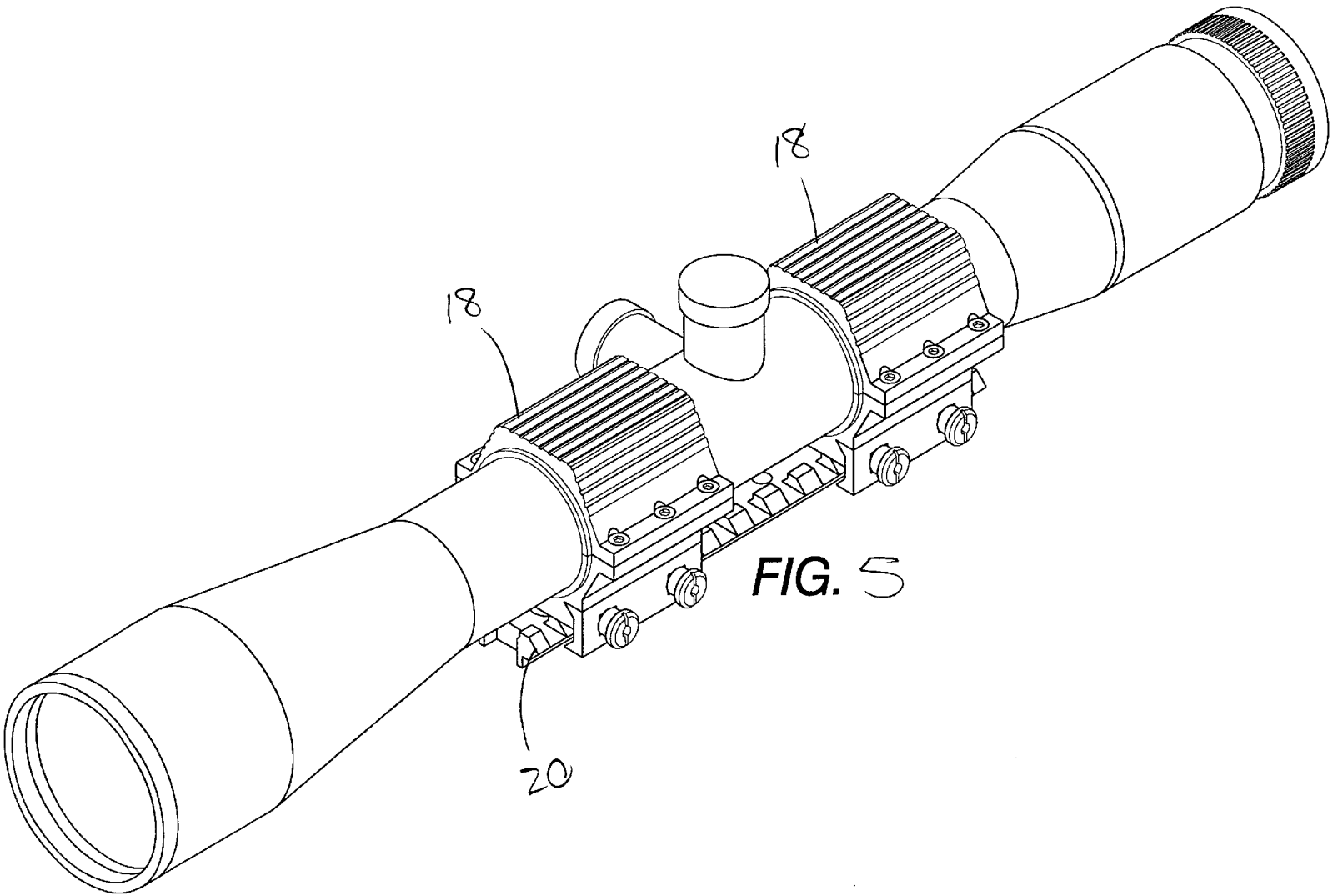
FIG. 5 illustrates a site installation using first and second reinforced scope rings in accordance with the method of the present invention.
Figure 10:
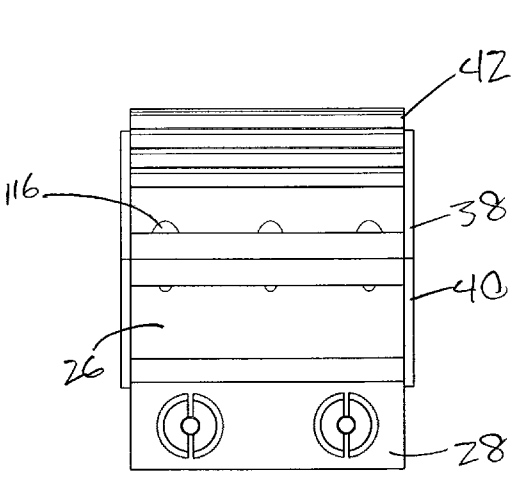
FIG. 10 is a left side view, in elevation, of the reinforced scope ring, in accordance with the present invention.
Figure 11:
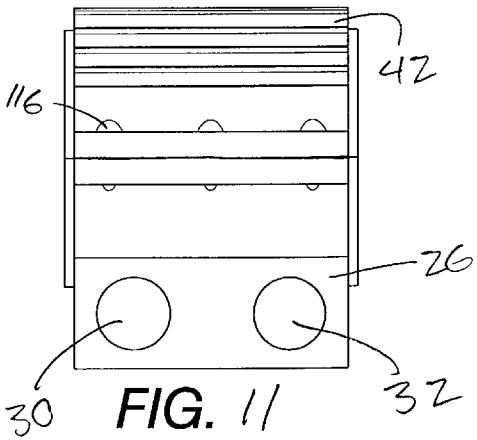
FIG. 11 is a right side view, in elevation, of the reinforced scope ring, in accordance with the present invention.
Figure 8:
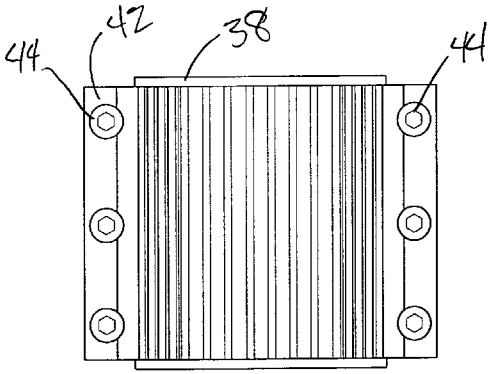
FIG. 8 is a top view, in elevation, of the reinforced scope ring, in accordance with the present invention.

Reinforced scope ring 18 can be used singly or (for weapons having especially severe recoil, such as rifles firing the 50 caliber BMG round) can be used in pairs, as shown in FIG. 5, a perspective view of the left side of a mounted telescopic sight 12 supported by two reinforced scope rings 18 attached to Picatinny rail 20.

In the preferred embodiment of the reinforced scope ring 18 illustrated in FIGS. 1, 2, 6, 7, 8, 9, 10 and 11, base 26 forms an interior semi-cylindrical surface terminating in first and second planar flange members having rectangular planar surfaces 110, 112. As best seen in the exploded perspective view of FIG. 1, planar flange surfaces 110 and 112 are co-planar and aligned along an imaginary plane bisecting the cylinder defined by reinforced scope ring 18. Preferably, each planar surface (e.g., 110) has a width dimension transverse to the axis of the cylinder of approximately 7 mm and a length dimension parallel to the axis of the cylinder of approximately 34 mm. Preferably, first, second and third threaded apertures are arranged in each of the flanges in a line and are adapted to receive threaded fasteners 44. Top ring member 42 has left and right flange members having planar flange surfaces parallel to an imaginary plane bisecting the imaginary cylinder defined by the reinforced scope ring 18. The top ring member planar flange surfaces are dimensioned with the same width and length as for the base planar flange surfaces and include first, second and third through-holes adapted to receive threaded fasteners 44. The top ring member left and right flanges are also counter-bored with larger diameter cylindrical bores bearing partly into the angled top ring wall to receive the larger head segments of threaded fasteners 44 in counter-sunk fashion. This larger bore side wall 116 can easily be seen in the side views of FIGS. 10 and 11.

Figure 9:
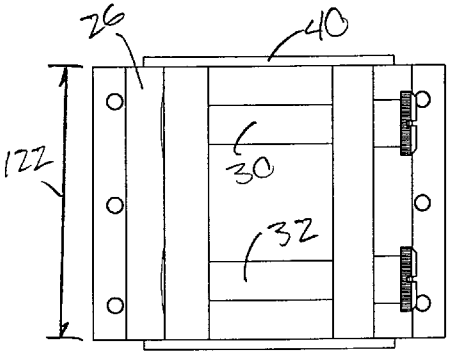
FIG. 9 is a bottom or underneath view, in elevation, of the reinforced scope ring, in accordance with the present invention.
Figure 6:
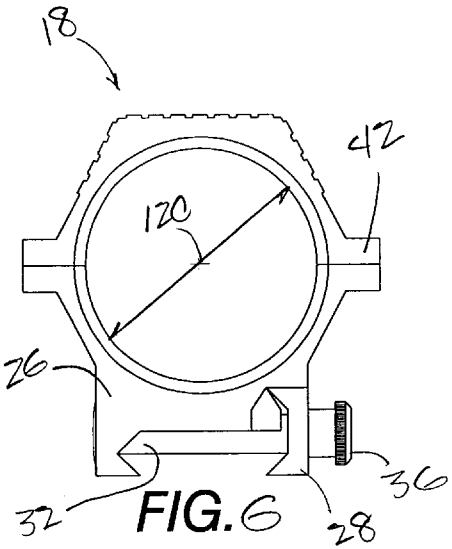
FIG. 6 is a front view, in elevation, of the reinforced scope ring, in accordance with the present invention.
Figure 7:
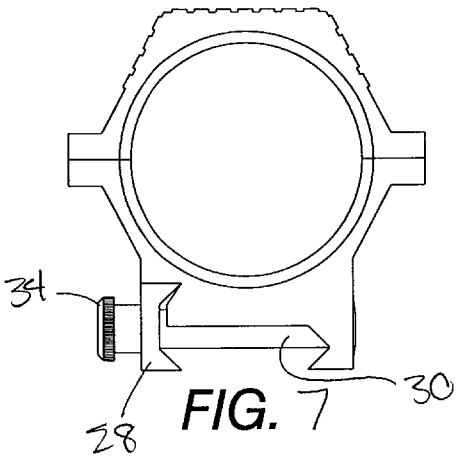
FIG. 7 is a rear view, in elevation, of the reinforced scope ring, in accordance with the present invention.

Referring now to FIGS. 6 through 11, it is readily seen that the axial length or extent of the cylinder defined by reinforced scope ring 18 is greater than the diameter 120 of the interior surface of the scope ring used to support the telescopic sight. The combination of extended axial length with the robust clamping surfaces (provided by the top ring member flanges and base flanges) provides sufficient support to permit use of a single reinforced scope ring to support a scope on a firearm. Employing three threaded fasteners 44 on each of the left and right sides of the reinforced scope ring provides even and widely distributed clamping pressure along the tubular body of the scope to be mounted. When the optional semi-cylindrical spacers 38 and 40 are not in use, the inside diameter of the scope ring is preferably 30 mm. With the optional semi-cylindrical members 38, 40 in place, their inside diameter then is reduced to a lesser diameter conventionally used for tubular telescope bodies, (e.g., one inch). In either case, the axial length of the reinforced scope ring 122 (as best seen in FIG. 9) is greater than the inside diameter 120. The added axial length also provides sufficient support and structural integrity to carry the first and second threaded lug fasteners 30, 32 at the desired spacing of 0.80 inches, thereby allowing alternate notches on rail 20 to be engaged. It has been discovered that this unique combination of geometries permits an extremely robust reinforced scope ring to be executed in a single unitary structure ideally well suited for applications for which severe recoil may be encountered.

Figures 12, 13, 14, 15:
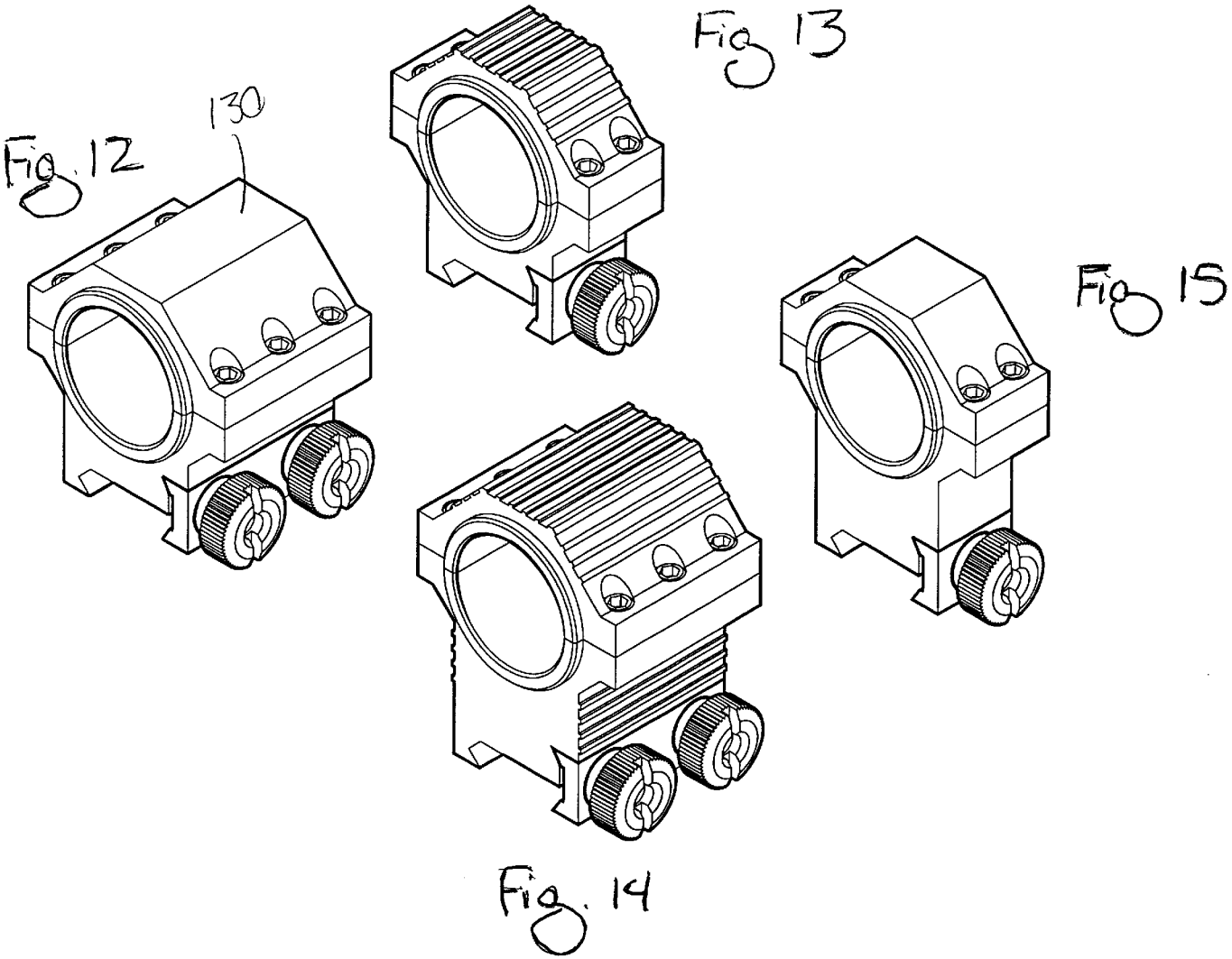
FIG. 12 is a perspective view from the front and left sides of another embodiment of the reinforced scope ring in the present invention.
FIG. 13 is a perspective view from the front and left sides of yet another embodiment of the reinforced scope ring in the present invention.
FIG. 14 is a perspective view from the front and left sides of yet another embodiment of the reinforced scope ring in the present invention, illustrating the ribbed structure on the sides of the base.
FIG. 15 is a perspective view from the front and left sides of the reinforced scope ring in the present invention.

In the preferred embodiment of FIGS. 6 through 11, a plurality of longitudinal grooves are machined into the first, second and third angled surfaces of top ring member 42. These provide an attractive design and an additional gripping surface while cutting down on glare and reflected light. FIGS. 12 through 15 illustrate alternate embodiments of the reinforced scope ring. In the alternate embodiment of FIG. 12, a smooth sided top ring member 130 is illustrated. FIG. 13 illustrates another alternative embodiment of the reinforced scope ring having a single transverse threaded lug fastener and two threaded fasteners to clamp the top ring member to the base. FIG. 14 illustrates yet another embodiment wherein a plurality of grooves are included in the base. FIG. 15 illustrates yet another embodiment in the present invention wherein the shortened body and shortened top member are finished in a smooth exterior surface.

Preferably, all of the components of reinforced scope ring 18 are machined from a suitable gunsmithing metal such as tool steel or stainless steel. Alternatively, base 26 and top ring member 42 may be fabricated from aluminum with removable jaw 28, first and second threaded lug fasteners 30, 32 and first and second knurled nuts 34, 36 being fabricated from steel. The first and second semi-cylindrical members for optional use with smaller scope bodies may be fabricated from a softer material such as softer metals or plastics.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A reinforced scope ring for installation on a firearm mount having a plurality of evenly spaced transverse notches, comprising:

a semi-cylindrical base member, said base member defining an interior semi-cylindrical surface terminating in first and second opposing substantially co-planar elongate flanges;

a semi-cylindrical top ring member having a semi-cylindrical interior surface terminating in third and fourth substantially planar elongate flanges and dimensioned to provide clamping force against said base member flanges;

said base member further including first and second transverse through-bores and first and second transverse grooves; said first transverse groove being aligned with said first transverse through-bore, and said second transverse groove being aligned with said second transverse through-bore;

a first transverse lug adapted to be received in said first base transverse bore, said first transverse lug having a substantially rectangular cross section and sized to be slidably received in said first base transverse groove;

a second transverse lug adapted to be received in said second base transverse bore and having a substantially rectangular cross section and sized to be slidably received in said second base transverse groove;

said first and second base transverse bores being spaced to position said first and second transverse lugs in alternate notches among first, second and third evenly spaced transverse notches, wherein a first notch engages said first transverse lug, a second notch is disposed between the first and third notches and the third notch engages said second transverse lug;

said semi-cylindrical top ring member and said base member defining a cylinder bore having an axial length and a bore inner diameter, said cylinder bore having an axial length greater than said bore inner diameter.

2. The reinforced scope ring of claim 1, wherein said semi-cylindrical top ring member and said base member define a cylinder and have an axial length greater than the cylinder inner diameter.

3. The reinforced scope ring of claim 1, wherein said base member includes first, second and third through bores arrayed longitudinally on said first elongate flange and fourth, fifth and sixth through bores arrayed longitudinally on said second elongate flange.

4. The reinforced scope ring of claim 1, wherein said semi-cylindrical top ring member includes first, second and third through bores arrayed longitudinally on said third elongate flange and positioned on said flange in a manner which permits alignment with said base member first, second and third through bores when said top ring third flange is juxtaposed with said base member first flange; and wherein said semi-cylindrical top ring member includes fourth, fifth and sixth through bores arrayed longitudinally on said fourth elongate flange and positioned on said flange in a manner which permits alignment with said base member fourth, fifth and sixth through bores when said top ring fourth flange is juxtaposed with said base member second flange.

5. The reinforced scope ring of claim 4, further including first second and third threaded fasteners sized to be received in said first, second and third top ring member through bores, and fourth, fifth and sixth threaded fasteners sized to be received in said fourth, fifth and sixth top ring member through bores.

6. The reinforced scope ring of claim 1, further including:

a removable jaw member having first and second transverse through-bores spaced in a manner permitting alignment with said base first and second transverse through-bores and sized to receive said first and second transverse lugs;

a first nut fastener adapted for engagement with said first transverse lug; and a second nut fastener adapted for engagement with said second transverse lug;

wherein said removable jaw member, said first nut fastener and said second nut fastener are dimensioned to fasten said base member to the firearm mount.

* * * * *